US011369177B2

(12) United States Patent
Robinault et al.

(10) Patent No.: US 11,369,177 B2
(45) Date of Patent: Jun. 28, 2022

(54) HAIR TREATMENT PROCESS AND SYSTEM

(71) Applicant: L'OREAL, Paris (FR)

(72) Inventors: Jean-Luc Robinault, Saint-Ouen (FR); Henri Samain, Chevilly LaRue (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 17/040,739

(22) PCT Filed: Apr. 5, 2019

(86) PCT No.: PCT/EP2019/058700

§ 371 (c)(1),
(2) Date: Sep. 23, 2020

(87) PCT Pub. No.: WO2019/197296

PCT Pub. Date: Oct. 17, 2019

(65) Prior Publication Data

US 2021/0007456 A1 Jan. 14, 2021

(30) Foreign Application Priority Data

Apr. 9, 2018 (FR) ..... 1853069

(51) Int. Cl.

| | |
|---|---|
| ***A45D 19/12*** | (2006.01) |
| ***A47K 3/28*** | (2006.01) |
| ***E03C 1/04*** | (2006.01) |
| ***A45D 19/00*** | (2006.01) |

(52) U.S. Cl.

CPC ..... *A45D 19/12* (2013.01); *A47K 3/285* (2013.01); *A47K 3/288* (2013.01); *E03C 1/0408* (2013.01); *A45D 19/005* (2021.01)

(58) Field of Classification Search

CPC ..... A47K 3/022
USPC ..... 4/574.1, 573.1, 575.1, 576.1, 577.1, 4/578.1, 589, 626, 625, 627, 628; 15/3.14, 21, 159.1

See application file for complete search history.

(56) References Cited

U.S. PATENT DOCUMENTS 3,984,546 A 10/1976 Brown et al.

FOREIGN PATENT DOCUMENTS

| | | | |
|---|---|---|---|
| EP | 2881025 | A1 | 6/2015 |
| WO | 2015165940 | A1 | 11/2015 |

OTHER PUBLICATIONS

International Search Report (ISR) for PCT/EP2019/058700 dated Jun. 26, 2019 (4 pages).
Written Opinion of the International Searching Authority for PCT/EP2019/058700 dated Jun. 26, 2019 (9 pages).

*Primary Examiner* — Lori L Baker
(74) *Attorney, Agent, or Firm* — Shumaker, Loop & Kendrick, LLP

(57) ABSTRACT

A system for washing the hair, including a first reservoir for receiving a first liquid (L1) constituted by or comprising water, a second reservoir for receiving a second liquid (L2) including a treatment product diluted in water in an amount of less than or equal to 2.5% by weight relative to the total weight of the second liquid (L2), a shower head with a supply rate of between 0.3 and 5 L/min, configured to deliver a jet of droplets onto the hair. The shower head is further supplied with liquid, taken exclusively from one or other of the reservoirs, with an overpressure.

22 Claims, 1 Drawing Sheet

HAIR TREATMENT PROCESS AND SYSTEM

TECHNICAL FIELD AND BACKGROUND

The present invention relates to the treatment of the hair, especially to cleanse it.

There are many situations in which people would like to get washed, in particular to wash their hair, but are, however, unable to do so due to limited access to water. This is the case, for example, for campers or hair stylists who would like to operate from a vehicle. In these places, electricity is generally available, but water needs to be brought there. It is generally calculated that, to wash the hair, a minimum of 5 L of water are required for premoistening the hair and for rinsing it. In reality, this amount may be greater and may be up to 20 L. For a family of campers, about 50 L of water are required, which makes the operation difficult. For a hair stylist who wishes to operate from a vehicle, he or she would need to bring hundreds of liters of water, depending on the number of clients they wish to treat in their working day.

Thus, there is a need to have a solution for washing, using little water, which is inexpensive and easy to use, even when it is desired to change the shampoo.

SUMMARY

The invention meets this need by means of a hair washing system, including:

- a first reservoir for receiving a first liquid constituted by or comprising water,
- a second reservoir for receiving a second liquid comprising a treatment product diluted in water in an amount of less than or equal to 2.5% by weight relative to the total weight of the second liquid,
- a shower head with a supply rate of between 0.3 and 5 L/min, configured to deliver a jet of droplets onto the hair,
- a means for supplying the shower head with liquid, taken exclusively from one or other of the reservoirs, with an over pressure.

The invention offers many advantages.

First, it makes it possible to wash a person's hair with little water, for example 2 L or less.

The cost of the system is limited because a single pump may suffice to make it function, in one implementation example. A pump is not even necessary at all in another implementation example.

The system according to the invention is especially easy to use, even if it is desired to change the treatment product, for example to change the shampoo. It suffices in this case to provide a third reservoir which can replace the second or to change the treatment product contained in the second reservoir once it is empty.

By means of the invention, people who do not have access to a running water supply or who have a variable water supply are able to wash their hair.

The invention allows the easy establishment of a hair washing station, in an isolated region without a running water supply, for example in the mountains, at the beach or in the countryside.

The invention also facilitates the creation of a mobile washing system, for which access to water is difficult.

The shower head needs to be supplied with liquid under pressure in order to function. The overpressure at the shower head inlet may be greater than or equal to 2 bar, better still greater than or equal to 6 bar. The shower head supply rate is preferably between 0.5 and 2.8 L/min, when the liquid contained in the first or the second reservoir is sprayed onto the hair.

The shower head is supplied exclusively from one or other of the reservoirs. In other words, the liquid can only be taken from one reservoir at any given moment, but during the same use, it may be taken successively from one or other of the reservoirs. The shower head may thus be supplied at any given moment either with the liquid contained in the first reservoir or with that contained in the second reservoir.

The shower head preferably includes outlet orifices for the liquid to be dispensed, with a diameter of less than 1 mm.

The shower head may include at least two nozzles arranged so as to bring into collision two jets leaving the shower head. The two nozzles generate jets, which are preferably convergent, which come into collision so as to reduce their speed and to transfer this kinetic energy into reduction of the droplet size; this makes it possible to have a wetting resultant jet while at the same time having low water consumption and not producing an unpleasant sensation on the scalp.

The system may include a pump to supply the shower head with liquid to be dispensed at the necessary overpressure. As a variant, the system includes a pipe with a height difference of greater than or equal to 20 m to supply the shower head with liquid to be dispensed at a sufficient overpressure. As another variant, the reservoirs are of the manual pump type to create an overpressure of air above the level of the liquid, like the reservoirs used for feeding herbicide sprayers.

The choice of the liquid taken up may be made in various ways.

In a first implementation example of the invention, the system includes a tube to be dipped in one or other of said reservoirs as a function of the liquid that it is desired to dispense on the hair. To change liquid, the user simply moves the tube from one reservoir to the other. Where appropriate, a clamp is provided to hold the tube in place relative to the reservoir, this clamp being able, for example, to hold the tube by means of a clip or collar and to include two jaws for gripping the wall of the reservoir.

In another implementation example of the invention, the system includes at least one valve for selectively connecting one or other of the reservoirs to the shower head. This valve is, for example, a three-way electrovalve. In this case, pipes solidly connected to the reservoirs may be provided and the valve(s) make it possible to select the active uptake pipe at any given moment.

Preferably, the system includes a tank for recovering the liquid used for the hair treatment. This may make it possible to further reduce the amount of water or of liquid containing the treatment product consumed and thus to perform a larger number of hair treatments for a given initial amount of water.

Where appropriate, the recovery tank is constituted by the first or the second reservoir.

The first reservoir preferably contains water without any additive.

The second reservoir preferably contains at least one diluted surfactant.

The amount of surfactant(s) in the second reservoir is preferably between 0.1% and 2.5% by weight and better still between 0.2% and 1.5% by weight relative to the total weight of the second liquid.

The capacity of the first reservoir may be between 1 and 50 L.

The capacity of the second reservoir may be between 1 and 50 L, and especially strictly greater than 1 L.

A subject of the invention, according to another of its aspects, is also a process for washing the hair, especially using a system as defined above, including the steps consisting in:

a) taking from a reservoir a treatment liquid including a treatment product diluted in water, especially in an amount of less than or equal to 2.5% by weight relative to the total weight of the second liquid, b) placing this treatment liquid under pressure to dispense it on the hair in the form of droplets, especially at a flow rate of between 0.3 and 5 L/min, c) taking up a rinsing liquid constituted by or including water, d) placing this rinsing liquid under pressure to dispense it on the hair in the form of droplets, especially at a flow rate of between 0.3 and 5 L/min.

The rinsing liquid may be taken from a reservoir. As a variant, the rinsing liquid is taken from a source of water present in nature. In this case, the advantage of the low water consumption according to the invention may be to reduce the need for treating the water taken, for example to filter and purify it. The rinsing liquid may thus be without any pressure when it is taken.

In one example of implementation of the process, the hair is first moistened by performing steps c) and d), washed by performing steps a) and b), and then rinsed by performing steps c) and d) again.

The liquid dispensed on the hair is advantageously recovered and recycled.

The treatment liquid may include, as mentioned above, an amount of surfactant(s) of between 0.1 and 2.5% by weight, better still between 0.2% and 1.5% by weight relative to the total weight of the treatment liquid.

The flow rate at which the rinsing liquid is dispensed on the hair is preferably between 0.5 and 2.8 L/min. This is preferably also the case for the treatment liquid.

The rinsing liquid may be taken from a reservoir with a capacity of between 1 and 50 L. This may also be the case for the treatment liquid.

Shower Head

The shower head is said to have a low flow rate because its nominal supply rate is between 0.3 and 5 L/min.

It is supplied with an overpressure and has one or more nozzles which have orifices for dispensing the liquid, of low cross section, making it possible to fractionate the water into fine droplets.

Preferably, there are two of these orifices and they are less than 1 mm in diameter. The low cross section of the orifices accelerates the liquid which passes through and the jet of liquid breaks into fine droplets.

The jets leaving the nozzles may strike each other to further improve the fractionation of the dispensed liquid.

First Liquid L1

The first liquid may be clear water, i.e. water without any cosmetic additive added.

It may or may not be drinking water.

The first liquid may also contain at least one cosmetic additive.

This additive may have been introduced initially into the water, before the first use, or during treatment. This additive may be an antimicrobial compound, for instance chlorinated derivatives (hypochlorite, chlorine, chloramine) or oxygenated derivatives (ozone). The additive may also be a flocculant such as an acrylamide polymer, an acrylic polymer or an acrylamide and acrylic copolymer. The additive may also be a fragrancing agent.

Second Liquid L2

The second liquid is water in which at least one treatment product has been diluted, preferably at least one surfactant.

The amount of surfactant(s) will preferably be from 0.1% to 2.5% by weight, better still from 0.2% to 1.5% by weight, relative to the total weight of the second liquid L2.

The second liquid is initially in an amount that is sufficient to be able to wash the hair while the shower head is supplied exclusively with liquid from the liquid taken from the second reservoir, when the treatment product must be delivered onto the hair.

The second liquid is thus different from a concentrate intended to be mixed with a flow of running water.

The water which has served to dilute the treatment product may be clear water, which may or may not be drinking water.

The second liquid may contain at least one cosmetic active agent other than a surfactant, for instance a haircare agent, such as silicone, polymers or fragrances.

The surfactant(s) are preferably chosen from anionic surfactants, amphoteric surfactants and nonionic surfactants, and mixtures thereof Anionic Surfactants The term "anionic surfactant" means a surfactant which includes, as ionic or ionizable groups, only anionic groups.

In the present description, a species is termed "anionic" when it bears at least one permanent negative charge or when it can be ionized into a negatively charged species, under the conditions of use of the composition of the invention, for example the medium or the pH, and not comprising any cationic charge.

The anionic surfactants may be sulfate, sulfonate and/or carboxylic (or carboxylate) surfactants. Needless to say, a mixture of these surfactants may be used.

It is understood in the present description that:

- the carboxylate anionic surfactants comprise at least one carboxylic or carboxylate function (—COOH or —$COO^-$) and may optionally also comprise one or more sulfate and/or sulfonate functions;
- the sulfonate anionic surfactants comprise at least one sulfonate function (—$SO_3H$ or —$SO_3^-$) and may optionally also comprise one or more sulfate functions, but do not comprise any carboxylate functions; and
- the sulfate anionic surfactants comprise at least one sulfate function but do not comprise any carboxylate or sulfonate functions.

Carboxylate Anionic Surfactants

The carboxylic anionic surfactants that may be used thus include at least one carboxylic or carboxylate function (—COOH or —$COO^-$).

They may be chosen from the following compounds: acylglycinates, acyllactylates, acylsarcosinates, acylglutamates; alkyl-D-galactosideuronic acids, alkyl ether carboxylic acids, alkyl(C6-30 aryl) ether carboxylic acids, alkylamido ether carboxylic acids; and also the salts of these compounds;

the alkyl and/or acyl groups of these compounds including from 6 to 30 carbon atoms, especially from 12 to 28, better still from 14 to 24 or even from 16 to 22 carbon atoms; the aryl group preferably denoting a phenyl or benzyl group;

these compounds possibly being polyoxyalkylenated, in particular polyoxyethylenated, and then preferably including from 1 to 50 ethylene oxide units and better still from 2 to 10 ethylene oxide units.

Use may also be made of the C6-C24 alkyl monoesters of polyglycoside-polycarboxylic acids, such as C6-C24 alkyl polyglycoside-citrates, C6-C24 alkyl polyglycoside-tartrates and C6-C24 alkyl polyglycoside-sulfosuccinates, and salts thereof.

Among the above carboxylic surfactants, mention may be made most particularly of polyoxyalkylenated alkyl(amido) ether carboxylic acids and salts thereof, in particular those including from 2 to 50 alkylene oxide and in particular ethylene oxide groups, such as the compounds sold by the company Kao under the Akypo names.

The polyoxyalkylenated alkyl(amido) ether carboxylic acids that may be used are preferably chosen from those of formula (1):

$$R_1—(OC_2H_4)_n—OCH_2COOA \quad (1)$$

in which:

R1 represents a linear or branched C6-C24 alkyl or alkenyl radical, a (C8-C9)alkylphenyl radical, a radical R2CONH—CH2-CH2- with R2 denoting a linear or branched C9-C21 alkyl or alkenyl radical, preferably, R1 is a C8-C20 and preferably C8-C18 alkyl radical, and aryl preferably denotes phenyl, n is an integer or decimal number (average value) ranging from 2 to 24 and preferably from 2 to 10, A denotes H, ammonium, Na, K, Li, Mg or a monoethanolamine or triethanolamine residue.

It is also possible to use mixtures of compounds of formula (1), in particular mixtures of compounds containing different groups R1.

The polyoxyalkylenated alkyl(amido) ether carboxylic acids that are particularly preferred are those of formula (1) in which:

R1 denotes a C12-C14 alkyl, cocoyl, oleyl, nonylphenyl or octylphenyl radical,

A denotes a hydrogen or sodium atom, and n ranges from 2 to 20, preferably from 2 to 10.

Even more preferentially, use is made of compounds of formula (1) in which R denotes a C12 alkyl radical, A denotes a hydrogen or sodium atom and n ranges from 2 to 10.

Preferentially, the carboxylic anionic surfactants are chosen, alone or as a mixture, from:

acylglutamates, in particular of C6-C24 or even C12-C20, such as stearoylglutamates, and in particular disodium stearoylglutamate;

acylsarcosinates, in particular of C6-C24 or even C12-C20, such as palmitoylsarcosinates, and in particular sodium palmitoylsarcosinate;

acyllactylates, in particular of C12-C28 or even C14-C24, such as behenoyllactylates, and in particular sodium behenoyllactylate;

C6-C24 and especially C12-C20 acylglycinates;

(C6-C24)alkyl ether carboxylates and especially (C12-C20)alkyl ether carboxylates;

polyoxyalkylenated ($C_6$-$C_{24}$)alkyl(amido) ether carboxylic acids, in particular those including from 2 to 50 ethylene oxide groups;

in particular in the form of alkali metal or alkaline-earth metal, ammonium or amino alcohol salts.

Sulfonate Anionic Surfactants

The sulfonate anionic surfactants that may be used include at least one sulfonate function (—$SO_3H$ or —$SO_3^-$).

They may be chosen from the following compounds: alkylsulfonates, alkylamidesulfonates, alkylarylsulfonates, α-olefin sulfonates, paraffin sulfonates, alkyl sulfosuccinates, alkyl ether sulfosuccinates, alkylamidesulfosuccinates, alkylsulfoacetates, N-acyltaurates, acylisethionates; alkylsulfolaurates; and also the salts of these compounds;

the alkyl groups of these compounds including from 6 to 30 carbon atoms, in particular from 12 to 28, better still from 14 to 24 or even from 16 to 22 carbon atoms; the aryl group preferably denoting a phenyl or benzyl group;

these compounds possibly being polyoxyalkylenated, in particular polyoxyethylenated, and then preferably including from 1 to 50 ethylene oxide units and better still from 2 to 10 ethylene oxide units.

Preferentially, the sulfonate anionic surfactants are chosen, alone or as a mixture, from:

C6-C24 and especially C12-C20 alkylsulfosuccinates, especially laurylsulfosuccinates;

C6-C24 and especially C12-C20 alkyl ether sulfosuccinates;

(C6-C24)acylisethionates and preferably (C12-C18)acylisethionates;

in particular in the form of alkali metal or alkaline-earth metal, ammonium or amino alcohol salts.

Sulfate Anionic Surfactants

The sulfate anionic surfactants that may be used include at least one sulfate function (—$OSO_3H$ or —$OSO_3^-$).

They may be chosen from the following compounds: alkyl sulfates, alkyl ether sulfates, alkylamido ether sulfates, alkylaryl polyether sulfates, monoglyceride sulfates; and the salts of these compounds;

the alkyl groups of these compounds including from 6 to 30 carbon atoms, in particular from 12 to 28, better still from 14 to 24 or even from 16 to 22 carbon atoms; the aryl group preferably denoting a phenyl or benzyl group;

these compounds possibly being polyoxyalkylenated, in particular polyoxyethylenated, and then preferably comprising from 1 to 50 ethylene oxide units and better still from 2 to 10 ethylene oxide units.

Preferentially, the sulfate anionic surfactants are chosen, alone or as a mixture, from:

alkyl sulfates, in particular of C6-C24 or even C12-C20, alkyl ether sulfates, in particular of C6-C24 or even C12-C20, preferably comprising from 2 to 20 ethylene oxide units;

in particular in the form of alkali metal or alkaline-earth metal, ammonium or amino alcohol salts.

Salts

When the anionic surfactant is in salt form, said salt may be chosen from alkali metal salts, such as the sodium or potassium salt, ammonium salts, amine salts and in particular amino alcohol salts, and alkaline-earth metal salts, such as the magnesium salt.

Examples of amino alcohol salts that may be mentioned include monoethanolamine, diethanolamine and triethanolamine salts, monoisopropanolamine, diisopropanolamine or triisopropanolamine salts, 2-amino-2-methyl-1-propanol salts, 2-amino-2-methyl-1,3-propanediol salts and tris(hydroxymethyl)aminomethane salts.

Alkali metal or alkaline-earth metal salts and in particular the sodium or magnesium salts are preferably used.

Preferentially, the anionic surfactants are chosen, alone or as a mixture, from:

C6-C24 and especially C12-C20 alkyl sulfates;

C6-C24 and especially C12-C20 alkyl ether sulfates; preferably comprising from 2 to 20 ethylene oxide units;

C6-C24 and especially C12-C20 alkylsulfosuccinates, especially laurylsulfosuccinates;

C6-C24 and especially C12-C20 alkyl ether sulfosuccinates;

(C6-C24)acylisethionates and preferably (C12-C18)acylisethionates;

C6-C24 and in particular C12-C20 acylsarcosinates; in particular palmitoylsarcosinates;

(C6-C24)alkyl ether carboxylates, preferably (C12-C20) alkyl ether carboxylates;

polyoxyalkylenated ($C_6$-$C_{24}$)alkyl(amido) ether carboxylic acids and salts thereof, in particular those including from 2 to 50 alkylene oxide and in particular ethylene oxide groups;

C6-C24 and especially C12-C20 acylglutamates;

C6-C24 and especially C12-C20 acylglycinates;

in particular in the form of alkali metal or alkaline-earth metal, ammonium or amino alcohol salts.

Amphoteric Surfactants

The amphoteric surfactants that may be used in the invention may be optionally quaternized secondary or tertiary aliphatic amine derivatives, in which the aliphatic group is a linear or branched chain including from 8 to 22 carbon atoms, said amine derivatives containing at least one anionic group, for instance a carboxylate, sulfonate, sulfate, phosphate or phosphonate group.

Mention may be made in particular of betaines and sulfobetaines (or sultaines), and also mixtures thereof, and in particular, alone or as a mixture:

betaine, (C8-C20)alkyl betaines, and especially cocoyl betaine;

(C8-C20)alkylamido(C1-C6)alkyl betaines, and in particular (C8-C20)alkylamidopropyl betaines such as cocamidopropyl betaine, (C8-C20)alkyl sulfobetaines.

Among the derivatives of optionally quaternized secondary or tertiary aliphatic amines that may be used, mention may also be made of the products having the following respective structures (A1) and (A2):

Ra—CON(Z)CH2-(CH2)m-N+(Rb)(Rc)(CH2COO—) (A1)

in which:

Ra represents a C10-C30 alkyl or alkenyl group derived from an acid Ra—COOH preferably present in hydrolyzed coconut kernel oil, a heptyl group, a nonyl group or an undecyl group, Rb represents a β-hydroxyethyl group, Rc represents a carboxymethyl group;

m is equal to 0, 1 or 2,

Z represents a hydrogen atom or a hydroxyethyl or carboxymethyl group,

Ra'—CON(Z)CH2-(CH2)m'—N(B)(B') (A2)

in which:

B represents —CH2CH2OX' with X' representing —CH2-COOH, CH2-COOZ', —CH2CH2-COOH, —CH2CH2-COOZ', or a hydrogen atom, B' represents —(CH2)z-Y', with z=1 or 2, and Y' representing —COOH, —COOZ', —CH2-CHOH—SO3H or —CH2-CHOH—SO3Z', m' is equal to 0, 1 or 2, Z represents a hydrogen atom or a hydroxyethyl or carboxymethyl group, Z' represents an ion derived from an alkali metal or alkaline-earth metal, such as sodium, potassium or magnesium; an ammonium ion; or an ion derived from an organic amine and especially from an amino alcohol, such as monoethanolamine, diethanolamine and triethanolamine, monoisopropanolamine, diisopropanolamine or triisopropanolamine, 2-amino-2-methyl-1-propanol, 2-amino-2-methyl-1,3-propanediol and tris(hydroxymethyl)aminomethane.

Ra' represents a C10-C30 alkyl or alkenyl group of an acid Ra'COOH preferably present in hydrolyzed coconut kernel oil or hydrolyzed linseed oil, an alkyl group, in particular a C17 alkyl group, and its iso form, or an unsaturated C17 group.

The compounds corresponding to formula (A2) are particularly preferred.

Among the compounds of formula (A2) for which X' represents a hydrogen atom, mention may be made of the compounds known under the (CTFA) names sodium cocoamphoacetate, sodium lauroamphoacetate, sodium caproamphoacetate and sodium capryloamphoacetate.

Other compounds of formula (A2) are known under the (CTFA) names disodium cocoamphodiacetate, disodium lauroamphodiacetate, disodium caproamphodiacetate, disodium capryloamphodiacetate, disodium cocoamphodipropionate, disodium lauroamphodipropionate, disodium caproamphodipropionate, disodium capryloamphodipropionate, lauroamphodipropionic acid and cocoamphodipropionic acid.

As examples of compounds of formula (A2), mention may be made of the cocoamphodiacetate sold by the company Rhodia under the trade name Miranol® C2M Concentrate, the sodium cocoamphoacetate sold under the trade name Miranol Ultra C 32 and the product sold by the company Chimex under the trade name Chimexane HA.

Use may also be made of the compounds of formula (A3):

Ra"—NH—CH(Y")—(CH2)n-C(O)—NH—(CH2)n'—N(Rd)(Re) (A3)

in which:

Ra" represents a C10-C30 alkyl or alkenyl group of an acid

Ra"—C(O)OH, which is preferably present in coconut kernel oil or in hydrolyzed linseed oil;

Y" represents the group C(O)OH, —C(O)OZ", —CH2-CH(OH)—SO3H or the group CH2-CH(OH)—SO3-Z", with Z" representing a cation resulting from an alkali metal or alkaline-earth metal, such as sodium, an ammonium ion or an ion resulting from an organic amine;

Rd and Re, independently of each other, represent a C1-C4 alkyl or hydroxyalkyl radical; and n and n', independently of one another, denote an integer ranging from 1 to 3.

Among the compounds of formula (A3), mention may be made especially of the compound classified in the CTFA dictionary under the name sodium diethylaminopropyl cocoaspartamide and especially the compound sold by the company Chimex under the name Chimexane HB.

Preferably, the amphoteric surfactants are chosen from betaine, (C8-C20)alkyl betaines, (C8-C20)alkylamido(C1-C6)alkyl betaines, (C8-C20)alkylamphoacetates and (C8-C20)alkylamphodiacetates, and mixtures thereof, and in particular from cocoyl betaine and cocoamidopropyl betaine.

Nonionic Surfactants

The nonionic surfactants that may be used in the invention may be chosen from alcohols, α-diols and (C1-20)alkylphenols, these compounds being polyethoxylated and/or polypropoxylated and/or polyglycerolated, the number of ethylene oxide and/or propylene oxide groups possibly ranging from 1 to 100, and the number of glycerol groups possibly ranging from 2 to 30; or alternatively these compounds comprising at least one fatty chain including from 8 to 30 carbon atoms and especially from 16 to 30 carbon atoms.

Mention may also be made of condensates of ethylene oxide and of propylene oxide with fatty alcohols; polyethoxylated fatty amides preferably containing from 2 to 30 ethylene oxide units, polyglycerolated fatty amides including on average from 1 to 5, and in particular from 1.5 to 4, glycerol groups; ethoxylated fatty acid esters of sorbitan preferably containing from 2 to 40 ethylene oxide units, fatty acid esters of sucrose, polyoxyalkylenated and preferably polyoxyethylenated fatty acid esters containing from 2 to 150 mol of ethylene oxide, including oxyethylenated plant oils, N—(C6-24 alkyl)glucamine derivatives, amine oxides such as (C10-14 alkyl)amine oxides or N—(C10-14 acyl) aminopropylmorpholine oxides.

Mention may also be made of nonionic surfactants of alkyl(poly)glycoside type, represented especially by the following general formula: R1O—(R2O)t-(G)v in which:

- R1 represents a linear or branched alkyl or alkenyl radical including 6 to 24 carbon atoms and especially 8 to 18 carbon atoms, or an alkylphenyl radical whose linear or branched alkyl radical includes 6 to 24 carbon atoms and especially 8 to 18 carbon atoms,
- R2 represents an alkylene radical including 2 to 4 carbon atoms,
- G represents a sugar unit including 5 to 6 carbon atoms,
- t denotes a value ranging from 0 to 10 and preferably from 0 to 4,
- v denotes a value ranging from 1 to 15 and preferably from 1 to 4.

Preferably, the alkyl(poly)glycoside surfactants are compounds of the formula described above in which:

- R1 denotes a linear or branched, saturated or unsaturated alkyl radical including from 8 to 18 carbon atoms,
- R2 represents an alkylene radical including 2 to 4 carbon atoms,
- t denotes a value ranging from 0 to 3 and preferably equal to 0,
- G denotes glucose, fructose or galactose, preferably glucose;
- the degree of polymerization, i.e. the value of v, possibly ranging from 1 to 15 and preferably from 1 to 4; the mean degree of polymerization more particularly being between 1 and 2.

The glucoside bonds between the sugar units are generally of 1-6 or 1-4 type and preferably of 1-4 type. Preferably, the alkyl(poly)glycoside surfactant is an alkyl(poly)glucoside surfactant. C8/C16 Alkyl(poly)glucosides 1,4, and in particular decyl glucosides and caprylyl/capryl glucosides, are most particularly preferred.

Among the commercial products, mention may be made of the products sold by the company Cognis under the names Plantaren® (600 CS/U, 1200 and 2000) or Plantacare® (818, 1200 and 2000); the products sold by the company SEPPIC under the names Oramix CG 110 and Oramix® NS 10; the products sold by the company BASF under the name Lutensol GD 70, or the products sold by the company Chem Y under the name AG10 LK.

Preferably, use is made of C8/C16-alkyl(poly)glycosides 1,4, in particular as an aqueous 53% solution, such as those sold by Cognis under the reference Plantacare® 818 UP.

Preferentially, the nonionic surfactants are chosen from (C6-24 alkyl)(poly)glycosides, and more particularly (C8-18 alkyl)(poly)glycosides, ethoxylated C8-C30 fatty acid esters of sorbitan, polyethoxylated C8-C30 fatty alcohols and polyoxyethylenated C8-C30 fatty acid esters, these compounds preferably containing from 2 to 150 mol of ethylene oxide, and mixtures thereof.

Various additives may be placed in the first or second reservoir to soften, fragrance, cleanse or treat the skin or the hair, such as polyols, fragrances, antimicrobial agents or antifungal agents. The concentration of these additives may range from 0.01% to 1% by weight, preferably with an additive/surfactant ratio of between 1% and 40%.

BRIEF DESCRIPTION OF THE FIGURES

The invention may be understood more clearly on reading the following detailed description of nonlimiting implementation examples thereof and on examining the appended drawing, in which.

DETAILED DESCRIPTION OF THE INVENTION

Figure 1:
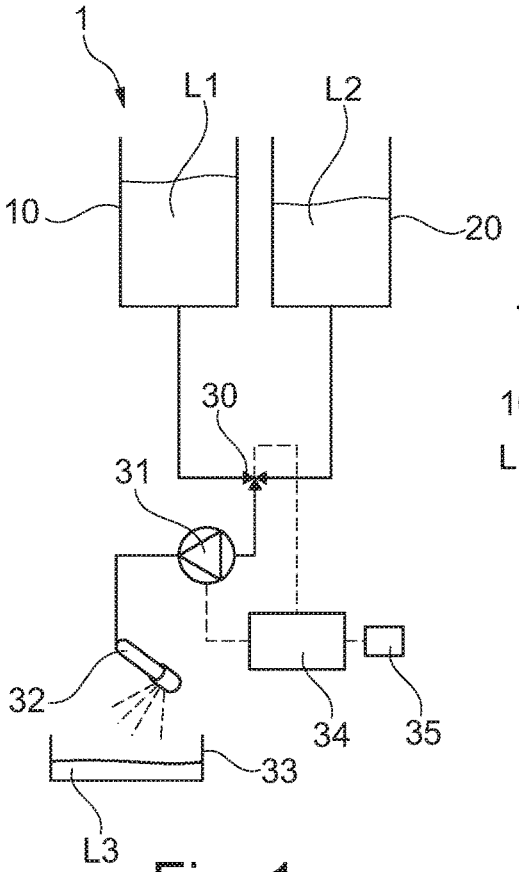
FIG. 1 is a partial schematic representation of an example of a hair treatment system according to the invention.

FIG. 1 shows one example of a system 1 according to the invention, including first 10 and second 20 reservoirs containing, respectively, first L1 and second L2 liquids to be dispensed.

The reservoirs 10 and 20 are connected via pipes communicating with an electrovalve 30, which is itself connected to the outlet of a pump 31 via a third pipe.

The pump 31 is connected to a shower head 32 via any type of pipe, with a certain length of hose ensuring the manouverability required for the shower head.

An electronic control system 34 can control the valve 30 and the pump 31. This control device 34 may include any type of man-machine interface, for example at least one button for selecting the reservoir from which the liquid is taken and a pump on-off button. The interface may also be more complex and may be arranged, for example, to prohibit the running of the pump if the reservoir from which the liquid is pumped is empty. In this case, suitable level sensors my be provided, connected to the control device.

Where appropriate, the button(s) for controlling the functioning of the system 1 may be at least partly located on the shower head 32.

In one example, the shower head includes a switch which the user can control with his finger to switch on the pump and a flap valve which opens only under a certain upstream pressure, so that when the pump is off, the liquid stops flowing from the shower head. The shower head 32 may also include, where appropriate, a button for selecting the reservoir which is to supply it.

A recovery tank 33 may be placed under the shower head 32 to recover at least part of the liquid L3 which has served for the washing, for example in order to recycle it.

The shower head 32 is said to have a low flow rate, i.e. under nominal functioning it is supplied with liquid at a flow rate of between 0.3 and 5 L/min.

This flow rate may be fixed or adjustable. For example, to vary the flow rate, the speed of the motor of the pump 31 may be modified via the interface 35 of the control device 34.

The pump 31 may be of any type, for example a centrifugal pump.

The electrical power for the system may be supplied by means of an accumulator, for example, which is recharged, for example, via solar panels.

The first reservoir 10 has, for example, a capacity of between 1 and 50 L, which is likewise the case for the second reservoir 20.

The reservoirs 10 and 20 may be open, as illustrated in FIG. 1, or as a variant may be closed, with, in this case, an air inlet, for example by means of a flap valve placed at the top of the reservoir.

When the system includes a valve 30 as illustrated, the contents of the reservoirs may be taken up via pipes emerging in the bottom thereof, as illustrated. As a variant, this uptake is performed by means of tubes dipping to the bottom of the reservoirs.

The first liquid L1 may be water and the second liquid L2 may be water supplemented with at least one surfactant, such that the amount of surfactant(s) is between 0.1% and 2.5% by weight relative to the total weight of the second liquid.

The functioning of the system 1 is, for example, as follows.

The system 1 is switched on via the interface 35 and the first reservoir 10 is selected, the liquid L1 being water. The shower head 32 is then used for a few seconds to moisten the hair. This step of premoistening the hair remains, however, optional.

Next, by means of the interface 35, the second reservoir 20 is selected, the second liquid L2 being water supplemented with a surfactant. The shower head 32 is then used for about 5 to 30 seconds, depending on the type of hair, to wash the hair.

Next, the hair is massaged, this step being optional. The hair is then rinsed. To do this, the interface 35 is again used to select the first reservoir 10 and the hair is rinsed with the shower head 32 for about 15 to 120 seconds, depending on the type of hair.

To simplify the system 1, it may be produced without the valve 30 and the control device 34 may be reduced, where appropriate, to a simple electrical supply controlled by an on-off switch. A manual valve 30 may also be used.

Figure 2:
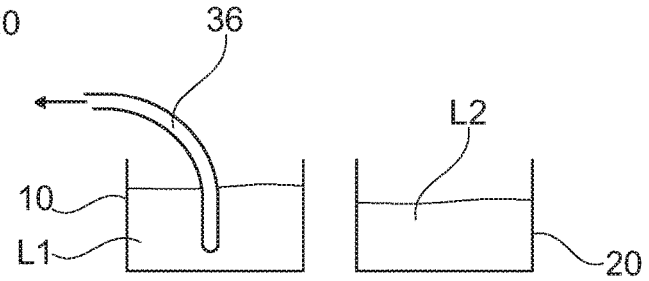
FIG. 2 illustrates the choice of the liquid to be dispensed by moving a suction tube.

In one implementation example, to select the liquid to be dispensed on the hair, reservoirs 10 and 20 which are open at the top may be used, as illustrated in FIG. 2, for example basins, with a suction tube 36 connected to the pump 31, which the user dips into the liquid of his choice.

Figure 3:
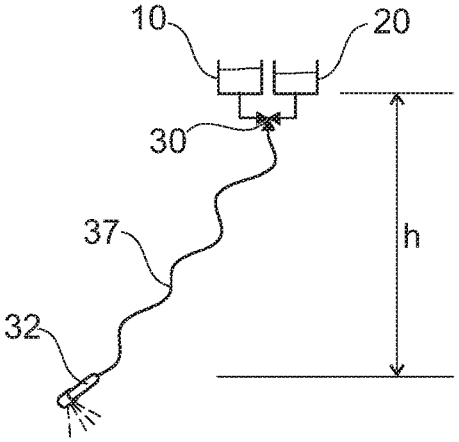
FIG. 3 illustrates the pressurizing of the liquid upstream of the shower head by means of a height difference.

In the variant illustrated in FIG. 3, the pump 31 is omitted, and the overpressure required for the functioning of the system is obtained by placing the reservoirs at a sufficient height relative to the shower head 32, by means of at least one pipe 37 of sufficient length.

The overpressure is then proportional to the height difference h. In practice, this height will be at least 20 m.

To further increase the autonomy of the system 1, the liquid dispensed on the hair may be recycled.

Figure 4:
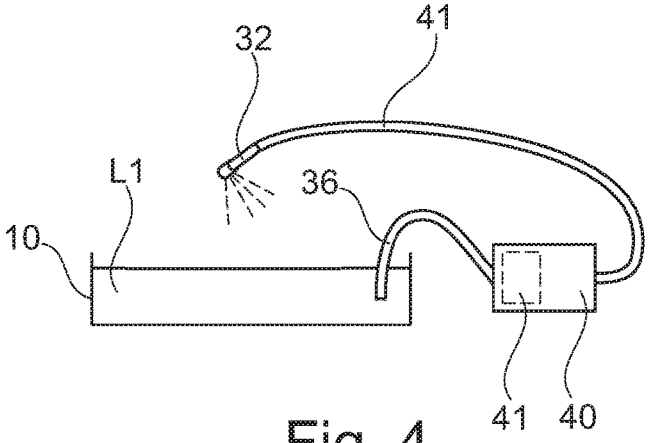
FIG. 4 illustrates the recycling of the liquid dispensed on the hair.

One possibility for doing this may consist in using one or other of the reservoirs 10 and 20 as a collection tank, as illustrated in FIG. 4. It is also possible to use a collection tank equipped with a discharge tube which returns the contents of the tank to one or other of the reservoirs 10 and 20.

When the rinsing water contains surfactant, it may be envisaged to recycle it into the second reservoir 20.

When the rinsing water contains very little or no surfactant, it may be envisaged to recycle it into the first reservoir 10, which corresponds to the situation illustrated in FIG. 4.

A relatively high total concentration of surfactant(s) may be envisaged, for example greater than or equal to 1% by weight, in the second reservoir, so that, in the course of the treatments, and despite the dilutions brought about by the recycling of the water, the surfactant content remains sufficient up to the end of the day.

The pump 31 may be incorporated in a housing 40 which contains a device 41 for treating the water that is recycled, for example to bring about the precipitation of certain cations such as calcium.

TREATMENT EXAMPLES

In these examples, a shower with a low flow rate having a supply rate of 2 L/min was used, with a supply pump set at 12 bar. The selection of the liquid taken is made by moving the suction tube, as described in reference to FIG. 2.

10 L of clear water were placed in a first basin acting as the first reservoir.

10 L of water containing 45 g of active material of a surfactant constituted by lauryl ether sulfate 2.2 ethylene oxide from the company BASF (Texapon N 70) were placed in a second basin acting as the second reservoir.

Example 1: Test on a Model of Frizzy Hair

The supply tube is placed in the second basin. The pump is started and, in so doing, the liquid constituted by the diluted surfactant is applied to the hair for 8 seconds, thus creating a substantial lather. The pump is switched off and the hair is massaged.

The supply tube is then moved to the first basin. The pump is switched on and the hair is targeted. For 8 seconds, the water dispensed produces more lather, then the water becomes clear. The pump is stopped after 44 seconds.

The hair is then dried and looks clean.

The process is simple and proves to be very economical in its use of water.

Example 2: Test on Several Models of Caucasian Hair and Recycling

The same process as previously is performed, the difference being that the collection tank is equipped with an outlet tube which returns its contents into the second basin.

It is seen that six models can be treated one after the other. In so doing, the process is very economical in its use of water.

Needless to say, the invention is not limited to the examples that have just been described.

For example, the system 1 according to the invention includes a means for regulating the pressure downstream of the pump.

The valve 30 may be replaced with several components, for instance a set of two one-way valves or taps placed, respectively, on the pipes connected to the first and second reservoirs.

The electric pump 31 may be replaced with a mechanical pump, actuated by hand or by foot, for example.

Although the invention is most particularly suitable for the washing of the hair, it is not excluded to use the shower head to wash the body or a part thereof.

The invention claimed is:

1. A system for washing the hair, including:

a first reservoir for receiving a first liquid constituted by or comprising water, a second reservoir for receiving a second liquid comprising a treatment product diluted in water in an amount of less than or equal to 2.5% by weight relative to the total weight of the second liquid, a shower head with a supply rate of between 0.3 and 5 L/min, configured to deliver a jet of droplets onto the hair, a means for supplying the shower head with liquid, taken exclusively from one or other of the reservoirs, but not from both reservoirs at the same time, with an overpressure.

2. The system as claimed in claim 1, the overpressure being greater than or equal to 2 bar.

3. The system as claimed in claim 1, including a pump for supplying the shower head with liquid to be dispensed with overpressure.

4. The system as claimed in claim 1, including a pipe with a height difference of greater than or equal to 20 m for supplying the shower head with liquid to be dispensed with overpressure.

5. The system as claimed in claim 1, including a tube to be dipped in one or other of said reservoirs as a function of the liquid that it is desired to dispense on the hair.

6. The system as claimed in claim 1, including at least one valve for selectively connecting one or other of the reservoirs to the shower head.

7. The system as claimed in claim 1, including a tank for recovering the liquid used for treating the hair.

8. The system as claimed in claim 7, the recovery tank being constituted by the first or the second reservoir.

9. The system as claimed in claim 1, the first reservoir containing water, and/or the second reservoir containing at least one diluted surfactant.

10. The system as claimed in claim 9, the amount of surfactant(s) in the second reservoir being between 0.1% and 2.5% by weight relative to the total weight of the second liquid.

11. The system as claimed in claim 9, the amount of surfactant(s) in the second reservoir being between 0.2% and 1.5% by weight relative to the total weight of the second liquid.

12. The system as claimed in claim 1, the capacity of the first reservoir being between 1 and 50 L and/or the capacity of the second reservoir being between 1 and 50 L.

13. The system as claimed in claim 1, the supply rate of the shower head being between 0.5 and 2.8 L/min and/or the shower head including outlet orifices for the liquid to be dispensed, with a diameter of less than 1 mm.

14. A process for washing the hair, including the steps consisting of:

a) taking from a first reservoir a treatment liquid including a treatment product diluted in water, b) placing this treatment liquid under pressure to dispense it on the hair in the form of droplets, c) taking a rinsing liquid from a second reservoir constituted by or including water, d) placing this rinsing liquid under pressure to dispense it on the hair in the form of droplets.

15. The process as claimed in claim 14, wherein the rinsing liquid is taken from a reservoir.

16. The process as claimed in claim 14, wherein the rinsing liquid is not under pressure when it is taken.

17. The process as claimed in claim 14, the hair first being moistened by performing steps c) and d), washed by performing steps a) and b), and then rinsed by performing steps c) and d) again.

18. The process as claimed in claim 14, the liquid dispensed on the hair being recovered and recycled.

19. The process as claimed in claim 14, the treatment liquid including a total mass concentration of surfactant(s) of between 0.1% and 2.5% a.

20. The process as claimed in claim 14, the flow rate at which the rinsing liquid (L1) is dispensed on the hair being between 0.5 and 2.8 L/min and/or the flow rate at which the treatment liquid is dispensed on the hair being between 0.5 and 2.8 L/min and/or the rinsing liquid being taken from a reservoir with a capacity of between 1 and 50 L.

21. A process for washing the hair, including the steps consisting of:

a) taking from a reservoir a treatment liquid including a treatment product diluted in water, b) placing this treatment liquid under pressure to dispense it on the hair in the form of droplets, c) taking up a rinsing liquid constituted by or including water, d) placing this rinsing liquid under pressure to dispense it on the hair in the form of droplets, the flow rate at which the rinsing liquid (L1) is dispensed on the hair being between 0.5 and 2.8 L/min and/or the flow rate at which the treatment liquid is dispensed on the hair being between 0.5 and 2.8 L/min and/or the rinsing liquid being taken from a reservoir with a capacity of between 1 and 50 L.

22. A system for washing the hair, including:

a first reservoir for receiving a first liquid constituted by or comprising water, a second reservoir for receiving a second liquid comprising a treatment product diluted in water in an amount of less than or equal to 2.5% by weight relative to the total weight of the second liquid, a shower head with a supply rate of between 0.3 and 5 L/min, configured to deliver a jet of droplets onto the hair, a means for supplying the shower head with liquid, taken exclusively from one or other of the reservoirs, with an overpressure, the system including a recovery tank for recovering the liquid used for treating the hair, the recovery tank being constituted by the first or the second reservoir.

* * * * *